United States Patent [19]

Pardini et al.

[11] Patent Number: 4,611,106

[45] Date of Patent: Sep. 9, 1986

[54] CIRCUIT BREAKER CONTACT STRUCTURE

[75] Inventors: Franco P. Pardini, Milan; Claudio Banfi, Rovello Porro, both of Italy

[73] Assignee: General Electric Company, New York, N.Y.

[21] Appl. No.: 607,866

[22] Filed: May 7, 1984

[30] Foreign Application Priority Data

May 9, 1983 [IT] Italy ..... 209992 A/83
Feb. 2, 1984 [IT] Italy ..... 20721/84[U]

[51] Int. Cl.[4] ..... H01H 33/18

[52] U.S. Cl. ..... 200/147 R; 335/16; 335/195; 200/144 R

[58] Field of Search ..... 200/147 R, 144 R; 335/16, 195

[56] References Cited

U.S. PATENT DOCUMENTS 3,277,407 10/1966 Kobayasi ..... 200/147 R
3,469,216 9/1969 Shiraishi ..... 335/195
3,555,471 1/1971 Mitskevich et al. ..... 200/147 R
3,943,473 3/1976 Khalid ..... 335/16
4,259,651 3/1981 Yamat ..... 335/16
4,375,021 2/1983 Pardini et al. ..... 200/147 R
4,458,224 7/1984 Kralik et al. ..... 335/16

*Primary Examiner*—Robert S. Macon
*Attorney, Agent, or Firm*—Richard A. Menelly; Walter C. Bernkopf; Fred Jacob

[57] ABSTRACT

A circuit breaker contact configuration reduces the occurrence of contact bounce by providing a reverse force to the contacts during contact closure. This reduces the contact closing shock energy, while keeping the contact bias force constant. In one embodiment, the reverse force is obtained by means of a counteracting spring which engages one of the contact arms at a point along the rebound path. Another embodiment comprises transferring the pivot point of one of the contacts from a first to a second position at a point along the rebound path.

7 Claims, 15 Drawing Figures

CIRCUIT BREAKER CONTACT STRUCTURE

BACKGROUND OF THE INVENTION

This invention relates to the configuration of electrical contacts used within electrical circuit breakers and, more particularly, to a current limiting circuit breaker such as described within U.S. Pat. No. 4,375,021 to Franco Pardini et al. The Pardini et al patent, which is incorporated herein for reference purposes, discloses that current limitation is obtained by the rapid gereration of a high voltage arc between the circuit breaker contacts. The rapid generation of the arc is obtained by rapidly separating the contacts to create a gap between the contacts. This gap is obtained within a very short time, in the order of milliseconds, and is created by utilizing electrodynamic or electromagnetic forces to separate the contacts. The contact separation speed is much faster under electrodynamic or electromagnetic forces when both contacts are moveable than when only one of the contacts is moveable and hence the arc voltage is generated at a faster rate.

However, the circuit breaker ability to handle the current can be adversely influenced by having both contacts moveable, because the contacts are more likely to "bounce" apart upon closing with the result that elemental arcing can occur causing the contacts to become welded together.

The purpose of this invention is to provide a contact arrangement with reduced occurrence of contact bounce without interfering with the operating mechanism or requiring increased contact bias forces.

SUMMARY OF THE INVENTION

The invention comprises a contact arrangement which includes a reverse motion spring or an additional pivot to provide higher overtravel with energy dissipation to the circuit breaker contacts upon closing to limit or eliminate contact bounce without reducing the contact force or requiring higher force from the operating mechanism. The arrangement of the invention is equally applicable to two moveable contacts, as well as to one moveable and one stationary contact.

GENERAL DESCRIPTION OF THE PRIOR ART

Figure 1A:
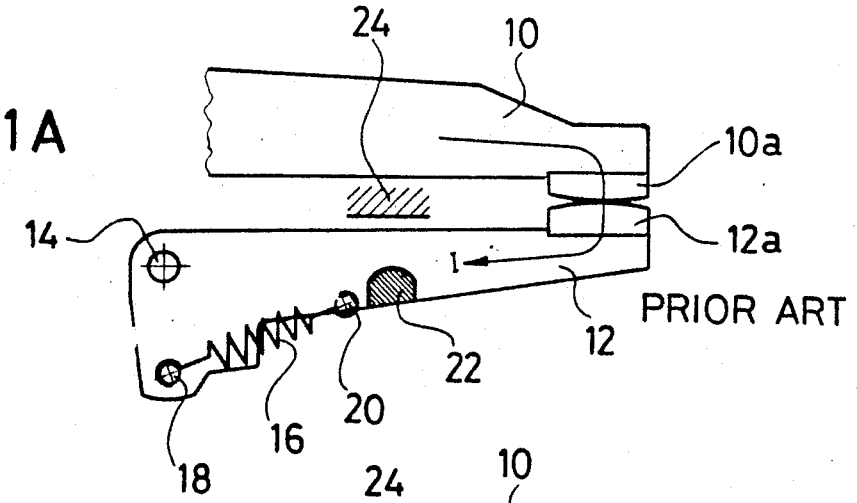
FIGS. 1A–1C each depict a side view of the contact arrangement of the prior art.

In order to reach a better understanding of the present invention, it is beneficial to determine what happens within a system of moveable upper and lower contact arms, respectively 10 and 12, of the prior art shown in FIG. 1 when the system is closed as a consequence of an external operating mechanism. In this instance, the moveable contact arm 10 is lowered until its contact 10*a* touches the contact 12*a* of the lower contact arm 12. The lower contact arm 12 can be rigidly fastened to the circuit breaker structure or can be moveable by pivoting it on a pin 14 abutting the contact carrying structure or carriage and fitting it with a contact spring 16 that operates between a first pin 18, rigidly connected with contact arm 12 and a second pin 20 on the contact carriage, resulting in the biasing of contact arm 12 towards contact arm 10. Contact arm 12 is made moveable to permit reciprocal motion between the contacts under the action of electrodynamic forces upon extremely high current through the contacts and contact arms as shown in FIG. 1. The provision of both contact arms being moveable produces a rapid separation of the contacts upon short circuit conditions so that the circuit breaker is able to achieve the desired current limiting feature.

As the contacts are closed by the operating mechanism (not shown) which ensures rapid contact closing, the force upon contact arm 10 rapidly moves the contact 10*a* against the contact 12*a* of the contact arm 12, rotating contact arm 12 around pin 14 against the bias of spring 16 as shown in FIG. 1A. This continued motion of contact arms 10 and 12 is termed "overtravel".

Figure 1B:
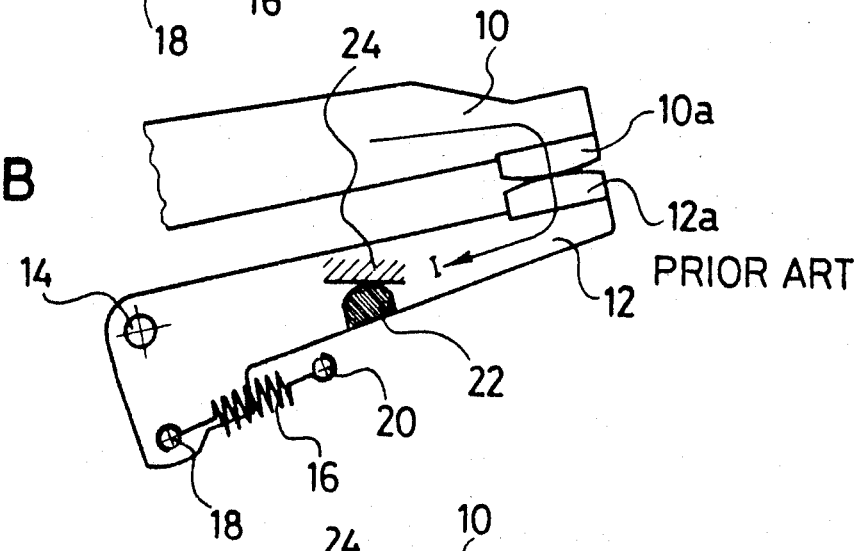
Figure 1C:
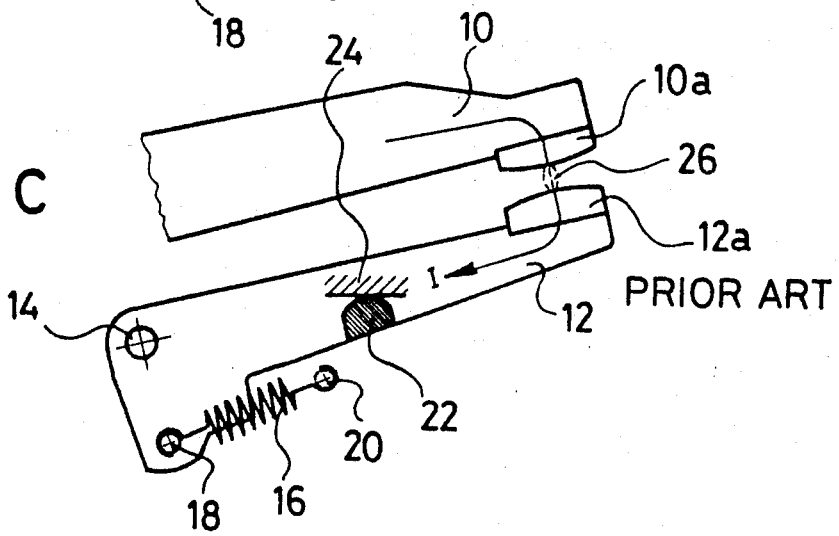

From the position of maximum overtravel given in FIG. 1A, contact 12 under the action of contact spring 16 moves to the position illustrated in FIG. 1B such that a projection 22 on contact arm 12 engages a stop 24 on the contact carriage. This is the normal rest position of contact arm 12 when the contacts are closed. However, if contact arm 12 is stopped abruptly upon contact between the projection 22 and the stop 24 during return motion while contact arm 10 continues to move beyond the normal rest position shown in FIG. 1B, this movement of the upper contact 10 beyond the normal rest position causes a separation between contacts 10*a* and 12*a* and temporary formation of an elemental arc 26 as shown in FIG. 1C. The arc current that continues to flow through the contacts can cause erosion and welding of the contacts. Then contact 10A returns to engagement with contact 12A under action of the closing force acting on contact arm 10.

DESCRIPTION OF THE PREFERRED EMBODIMENT

Figure 2A:
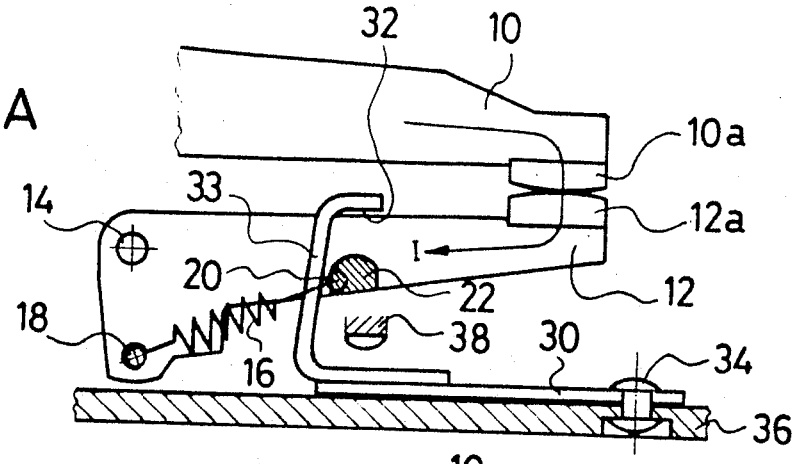
FIGS. 2A–2C each depict a side view of one embodiment of the contact arrangement according to the invention.
Figure 2B:
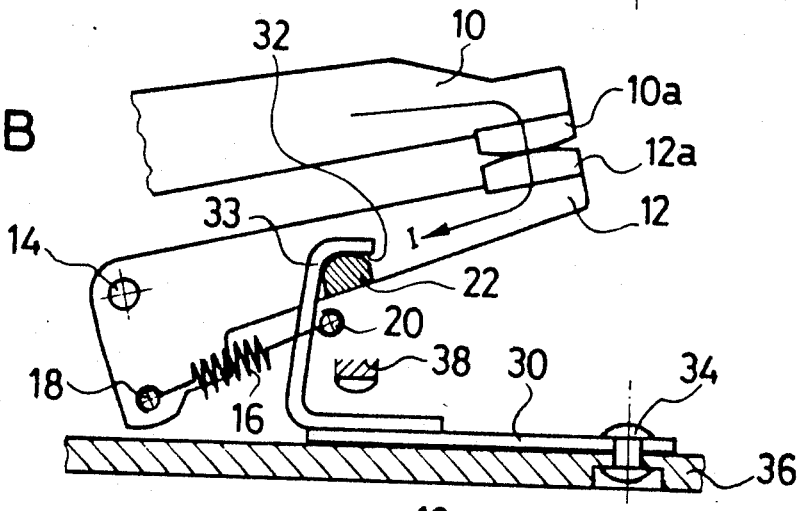
Figure 2C:
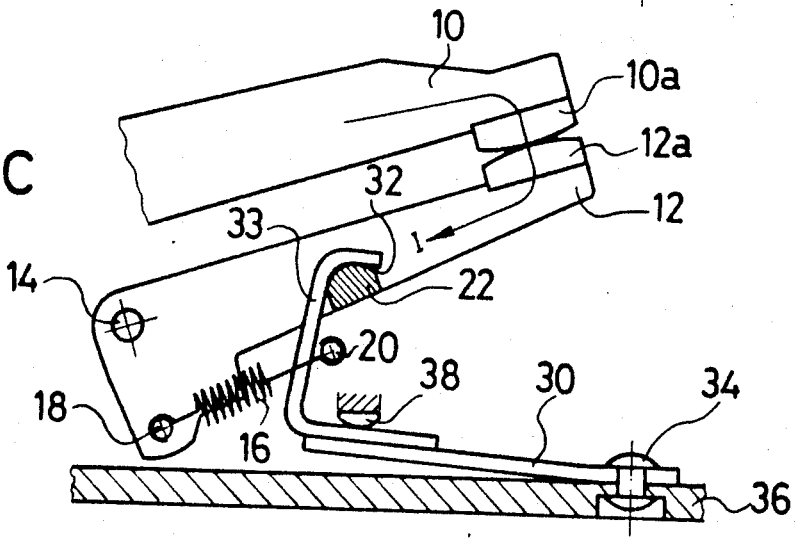

A first embodiment of the invention as shown in FIGS. 2A–2C includes contact arm 10 and contact arm 12 with contact spring 16 and pivot point 14 around which contact arm 12 rotates. Also included is a reversing spring 30 which operates at a certain point of the contact overtravel to progressively oppose the action of the contact spring 16, thereby decreasing the kinetic energy of both contact arm 12 and contact arm 10 during overtravel so that the contacts do not become separated.

Preferably, the reversing spring 30 is engaged by the projection 22 on contact arm 12 and, by becoming extended, delevops an opposing force which decreases the effect of the contact spring 16 until it contacts spring stop 38 formed on the stationary support structure 36 of the circuit breaker.

The reversing spring 30 preferably is a leaf spring joined at one of its ends with a bracket support 33 which engages the projection 22 on the stationary contact arm 12 and secured at its other end to the stationary support structure 36 of the circuit breaker.

Figure 3A:
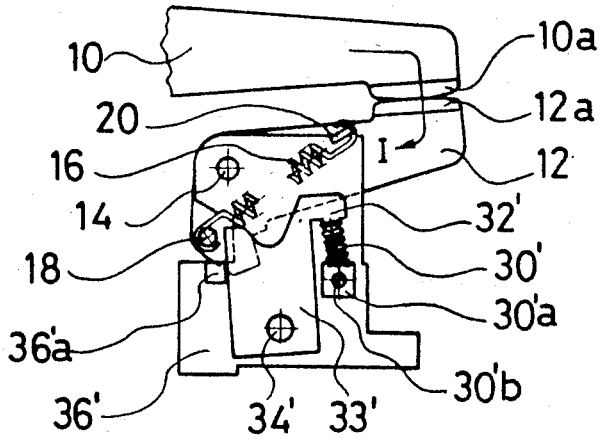
FIGS. 3A–3C each depict a side view of a variation of the embodiment depicted in FIGS. 2A–2C.
Figure 3B:
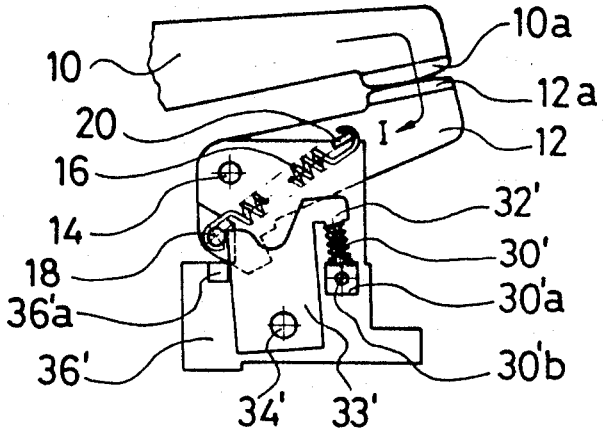
Figure 3C:
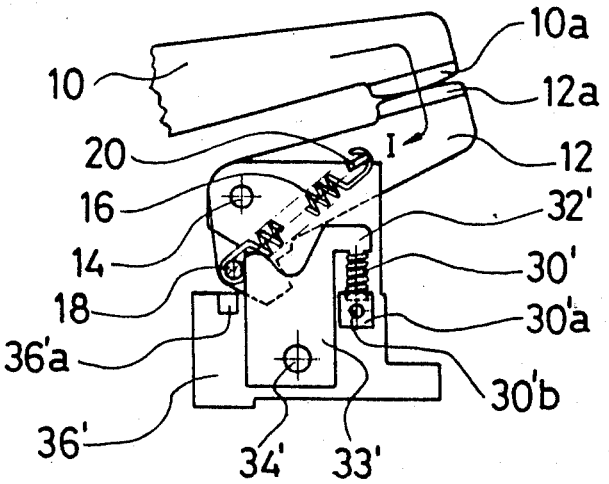

A variation of the first embodiment of FIGS. 2A–2C is depicted by FIGS. 3A–3C wherein, instead of the leaf spring 30, a helical spring 30' is used as a reversing spring which operates by compression between an extension 32' of a lever member 33', having the shape of a small metal plate pivotally mounted on a pin 34', secured to a carriage structure 36' and a support **30'*a* also secured to the carriage structure 36'**.

Figure 4A:
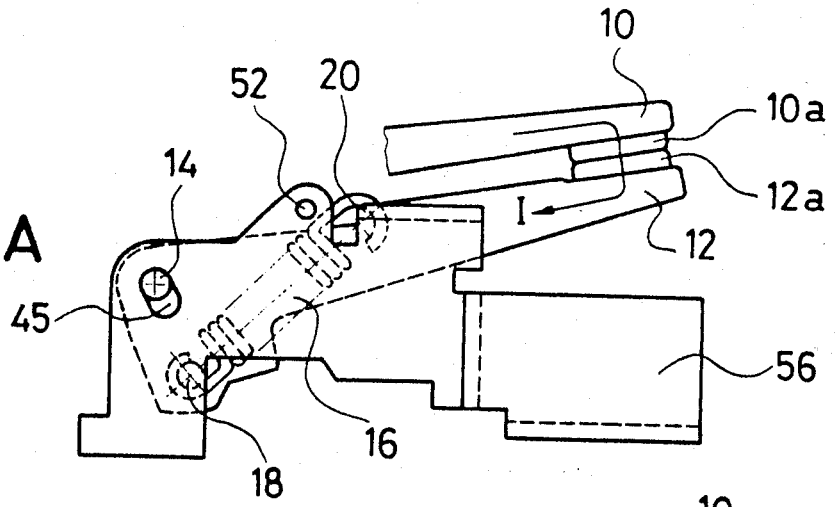
FIGS. 4A–4C each depict a side view of a further embodiment of the contact arrangement of the invention.
Figure 4B:
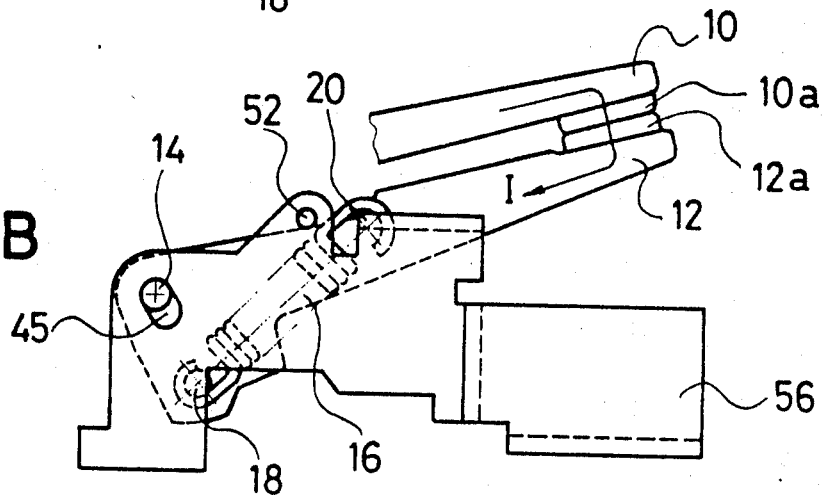
Figure 4C:
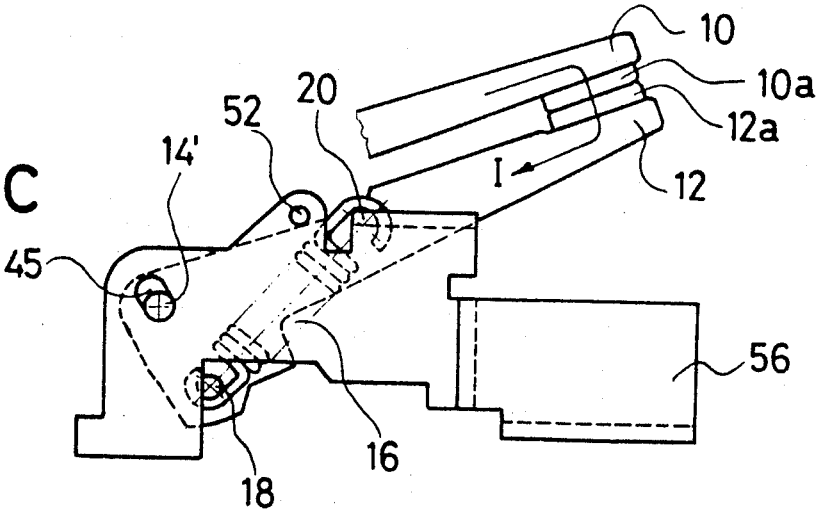

A second embodiment of the invention is shown in FIGS. 4A–4C and also includes an upper contact arm 10, a lower contact arm 12 and a contact spring 16. The pivot around which contact arm 12 rotates includes a pivot pin 14 formed on contact arm 12 and captured within an elongated slot 45 provided within the contact carriage to allow a limited movement of the pin 14 from a first position at one end of the slot 45 to a second position at the other end of the slot 45. In order to compensate for the increased overtravel, the moment of force operating on the lower contact arm 12 is decreased by a second pivot pin 52 around which the lower contact 12 rotates while the first pin 14 moves within slot 45. The new pivot pin 52 presents a moment arm for the contact spring 16 which is decreased in respect to the first pivot pin 14 so that a decreased moment of force operates on the lower contact arm 12. The kinetic energy of both the lower contact arm 12 and of the upper contact arm 10 is strongly decreased during the additional overtravel so that the contacts do not become separated.

Ideally, the second pivot point 52 is arranged on the lower contact arm 12 at an intermediate position between a first end carrying the first pivot point 14, and a second end carrying the contact **12*a*. The applied contact force then balances the force from the spring 16 since the intermediate pivot point 52 presenting a reduced moment arm to the force of the contact spring 16 will decrease the resulting moment of force and, as a result, the kinetic energy associated with both of the contact arms 10 and 12** is also decreased.

A more detailed explanation as to the diminishing of the kinetic energy on the contacts with the aforementioned contact arrangements is as follows.

In FIGS. 2A–2C, the force associated with the contact spring 16 is reduced by the reversing spring 30. Since the projection 22, instead of engaging the stop 24 as with the prior art arrangement depicted in FIGS. 1A–1C, engages the bracket end 32 connected by means of bracket support 33 with the reversing spring 30. In the embodiment depicted in FIGS. 2A–2C, the leaf spring 30 is secured, for example, by means of a rivet 34 to the breaker support structure 36 and is stopped during its extension against the stop 38 formed on the circuit breaker contact carriage. Upon a contact closing operation, the upper contact arm 10 strikes the lower contact arm 12 pushing it towards the breaker support structure 36 until it reaches the position shown in FIG. 2A. At this point, the contact spring 16 begins forcing the lower contact arm 12 upwards to the position shown in FIG. 2B. When the lower contact arm 12 reaches the position shown, projection 22 engages the bracket top 32 which is joined through the bracket support 33 to the reversing spring 30. While the lower contact arm 12 continues its travel, the reversing spring 30 increasingly deforms and produces an increasing moment of force opposite in direction from that produced by the force of the contact spring 16 which continuously diminishes as the contact arms 12, 10 move from the position indicated in FIG. 2B to that shown in FIG. 2C. The moment of force produced by the decreasing force exerted by the contact spring is effectively counteracted by the increasing moment of force provided by the reversing spring 30 in such a manner that the kinetic energy associated with the two springs in accordance with the invention is very much reduced. By the time the lower contact arm 12 stops and spring 30 engages against spring stop 38, reversing spring 30 will have sufficiently decreased the kinetic energy associated with the upper contact arm 10 to prevent the temporary separation of the contacts **10*a* and 12*a***.

Similarly, in FIGS. 3A–3C, the force associated with the contact spring 16 is reduced by the reversing spring 30'. In the configuration depicted in FIG. 3A the pin 18 reaches its furthest clockwise position allowing the lever member 33' to rest against a stop member **36'*a* on carriage 36'**.

Further, the pin 18, under the action of the spring 16 reaches the position depicted in FIG. 3B engaging one end of the lever member 33', forcing it to rotate clockwise around its pin 34', disengaging it from the stop member **36'*a* and compressing one end of the helical spring 30', through extension 32', the other end of the spring being held by support 30'*a* which is pivotably mounted on pin 30'*b***.

While the lower contact arm 12 continues its travel, the reversing spring 30' becomes increasingly compressed and produces an increasing moment of force opposite in direction from the force produced by contact spring 16 which continuously diminishes as the contact arms 12, 10 move from the position indicated in FIG. 3B to that shown in FIG. 3C. The moment of force about pin 14 produced by the decreasing force exerted by contact spring 16 is effectively counteracted by the increasing force acting on pin 18 provided by the reversing spring 30' operating through lever 33' such that the resulting kinetic energy associated with both springs 30', 16 is greatly reduced by the time that the lower contact arm 12 stops, and the reversing spring 30' is completely compressed, the reversing spring will have sufficiently decreased the kinetic energy associated with the upper contact arm 10 to prevent the temporary separation of the contacts **10*a* and 12*a***.

In the embodiment depicted in FIGS. 4A–4C, the modification of the moment of force associated with contact arm 12 caused by spring 16 is obtained by transferring the rotation of the lower contact arm 12 from a first pivot pin 14 to a second pivot stop pin 52 which reduces the effective moment arm of contact spring 16. As shown in FIGS. 1A–1C, 2A–2C and 3A–3C pivot pin 14 is captured within an elongated slot 45 which allows the pin to move from one end to the other of the slot, as best seen by comparing FIGS. 4B and 4C. Slot 45 is shown within carriage 56, however, it is to be clearly understood that the second contact arm 12 can be slotted and the pivot pin 14 can be attached to the carriage and operate in a similar manner. Also included in the embodiment depicted in FIGS. 4A–4C is a second pivot-stop 52 formed on contact carriage 56 which the lower contact arm 12 strikes during the return motion of contact arms 10, 12 as shown in FIG. 4B. The lower contact arm 12 then rotates about stop pin 52 to the position shown in FIG. 4C, after which it returns to the rest position shown in FIG. 4A.

Figure 5:
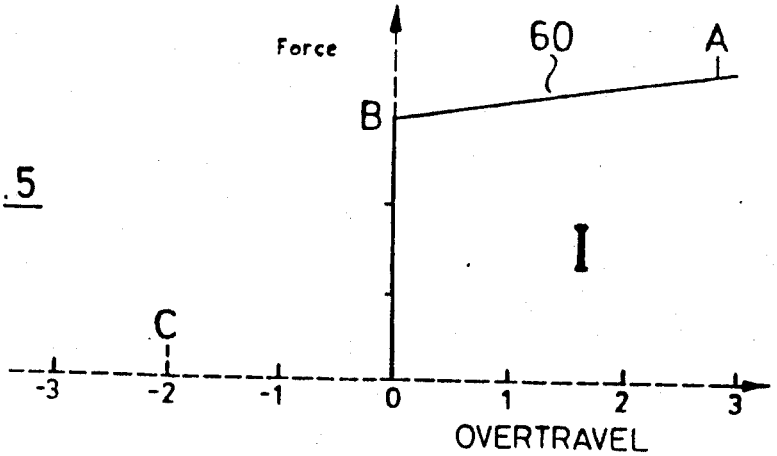
FIG. 5 is a graphic representation of the contact force as a function of contact overtravel for the prior art arrangement of FIGS. 1A–1C.
Figure 6:
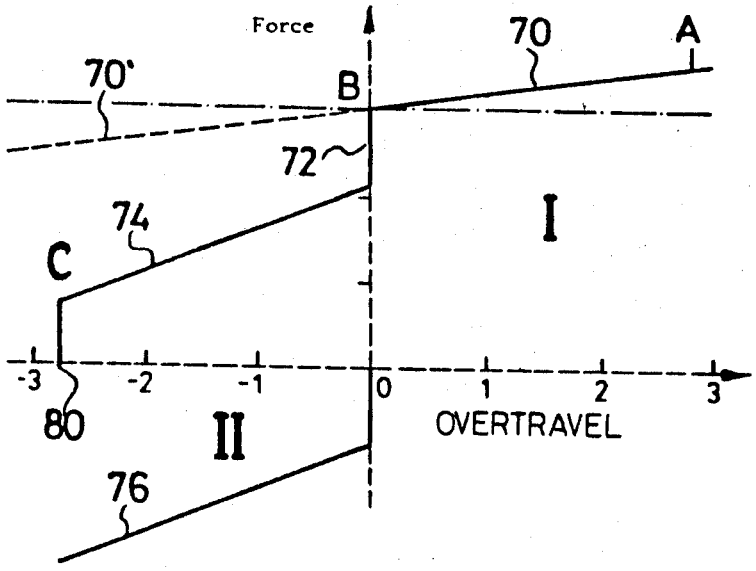
FIG. 6 is a graphic representation of the contact force as a function of contact overtravel for the embodiment depicted in FIGS. 2A–2C and 3A–3C.
Figure 7:
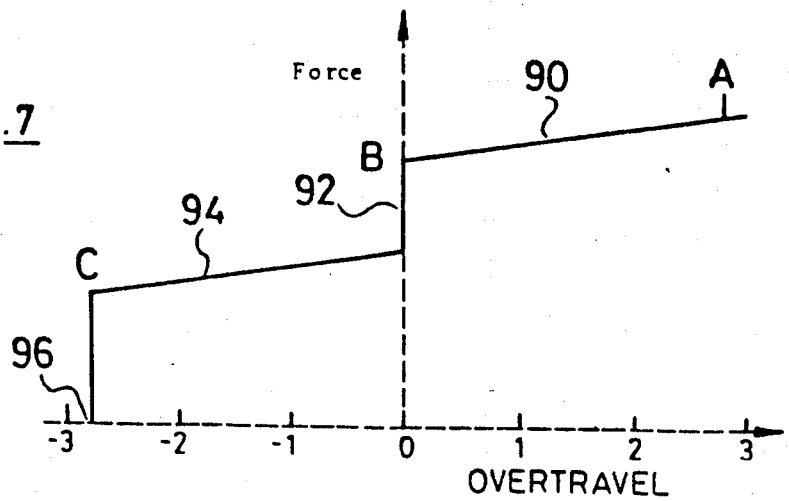
FIG. 7 is a graphic representation of the contact force as a function of contact overtravel for the embodiment depicted in FIGS. 4A–4C.

The displacement of pivot pin 14 within slot 45 allows the additional overtravel while the concomitant transfer of the rotation from pivot pin 14 to the second pivot-stop pin 52 reduces the energy associated with contact spring 16 and hence the kinetic energy of upper contact arm 10, when forced upwards by the lower contact arm 12, thereby preventing the temporary separation of their contacts (10*a*, 12*a*). To better understand the operation of the present invention, reference is now made to FIGS. 5, 6 and 7 showing respectively the contact closing force diagrams for the structures depicted in FIGS. 1A–4C. Referring specifically to FIG. 5, when the circuit breaker of the prior art shown in FIGS. 1A–1C is closed, the contact closing force in relative units takes up the values shown on the line 60 until it reaches a maximum value at A which corresponds to the maximum overtravel of the contacts with the contact spring fully extended as shown in FIG. 1A. At this point, the contacts start returning towards the center point B which corresponds to the position depicted in FIG. 1B. When the lower contact arm projection 22 abuts against the stop 24, the upper contact arm 10 continues moving, separating itself from the lower contact arm 12 until it reaches point C on the diagram which corresponds to the reverse overtravel position shown in FIG. 1C. FIG. 5 shows that the energy associated with the contacts upon closing is particularly high, as represented by the area I included between line 60 and the horizontal axis of the diagram and hence the reason for contact bounce when the lower contact arm 12 abuts against the stop 24 on its return travel from the maximum overtravel position at point A.

FIG. 6 shows a force diagram for contact arrangements depicted in FIGS. 2A–2C and 3A–3C. As soon as the circuit breaker closes, the lower contact arm 12 moves until it reaches the position depicted in FIGS. 2A and 3A and the force between the contact arms 10, 12 operating along line 70 reaches its maximum value at A corresponding to the maximum extension of spring 16. At this time, spring 16 returns contact arm 12 into the position indicated at FIGS. 2B and 3B where reversing spring 30 or 30' becomes engaged as indicated. The reversing spring force is illustrated by line 76 as a force operating in a direction opposite to that of spring 16, the absolute value of which increases with the distance of additional reverse overtravel, as described earlier. The additional reverse overtravel stops at point 80 corresponding in FIGS. 2C and 3C to the point where the reversing spring 30 or 30' abuts against the spring stop 38 or 30'*a*. At this point, the force operating on contact arm 12 is given by the algebraic sum of the force produced by the contact spring 16, represented by line 70, and the force generated by the reversing spring 30 or 30', represented by line 76. This is indicated as line 74. The reduction in force due to the engagement of the reversing spring 30 or 30' is indicated at step 72.

From FIG. 6, it follows that the energy exerted upon contact arm 12 results from the difference between the area I due to the contact spring 16 and the area II due to the reversing spring 30 or 30', thus resulting in a decreased amount of energy transferred to contact arm 10. Contact arm 10 has therefore a rebound amplitude lower than that provided by the prior art structure as depicted in FIGS. 1A–1C sufficient to avoid contact separation.

In a similar manner, FIG. 7 illustrates the behavior of the force operating on the lower contact arm 12 as a function of the additional overtravel in accordance with the embodiment depicted in FIGS. 4A–4C. As soon as the circuit breaker closes, the lower contact arm 12 overtravels until it reaches the position depicted in FIG. 3A and the force between upper contact arm 10 and lower contact arm 12 operates along line 90 reaching a maximum value at A corresponding to the maximum extension of contact spring 16. At this point, the contact spring forces lower contact arm 12 to reverse overtravel to the position indicated in FIG. 4B where lower contact arm 12 engages the second pivot-stop pin 52 that provides a shorter moment arm for contact spring 16 than that provided by pivot 14. Step 92 represents the decrease in the force operating on the lower contact arm 12. Pin 14 now slides within the slot 45 to the position indicated in FIG. 4C which corresponds to the additional reverse overtravel stopping point 96 in FIG. 7.

From FIG. 7 it can be seen that the energy exerted upon lower contact arm 12 is decreased by the reduction of the force moment generated by the contact spring 16 in a manner similar to the energy decrease depicted earlier in FIG. 6.

Having thus described our invention, what we claim as new and desire to secure by Letters Patent is:

1. A contact arrangement for electrical circuit breakers comprising:

a pair of first and second contacts attached to one end of corresponding first and second movable contact arms;

a first spring associated with said first movable contact arm for biasing said first movable contact arm in a first direction and holding said second contact against said first contact; and second spring attached to a support structure and having a first end proximate a first stop on said first movable contact arm, for engaging said first stop when said first and second movable contact arms move together in said first direction to prevent said first and second contacts from becoming separated.

2. The contact arrangement for electrical circuit breakers of claim 1 including a second stop attached to said support structure and extending proximate said second spring for contacting said second spring to prevent said first and second movable contact arms from moving beyond a predetermined distance in said first direction.

3. The contact arrangement for electrical circuit breakers of claim 2 wherein said second spring comprises a leaf spring having a bend at said first end and said first stop comprises a stop pin projecting from said first movable contact arm.

4. A contact arrangement for electrical circuit breakers comprising:

a pair of first and second contacts attached to one end of corresponding first and second movable contact arms;

a stationary support, said first movable contact arm being pivotally attached to said support;

a first spring attached at one end to said support and at an opposite end to a projecting pin on said first movable contact arm to bias said first movable contact arm in a first direction and to hold said first contact against said second contact; and a lever pivotally attached to said support and having an extension biased against said support by means of a second spring;

whereby said projecting pin strikes said lever when said first and second movable contact arms move together in said first direction thereby rotating said lever in a second direction opposite said first direction against said second spring bias to prevent said first and second contacts from becoming separated.

5. The contact arrangement for electrical circuit breakers of claim 4 wherein said first spring comprises an extension spring and said second spring comprises a compression spring.

6. A contact arrangement for electrical circuit breakers comprising:

a pair of first and second contacts attached to one end of corresponding first and second movable contact arms;

a stationary support and a contact carriage, said first movable contact arm being pivotally attached to said support by means of a compression spring and to said carriage by means of a pivot pin extending through an elongated slot within said carriage; and a stop pin on said carriage positioned for contacting with a top surface of said first movable contact arm when said first movable contact arm rotates in a counterclockwise direction to strike said stop pin thereby moving said pivot pin downwards with said slot and causing said first movable contact arm to then pivot about said stop pin.

7. The contact arrangement for electrical circuit breakers of claim 6 wherein said pivot pin is arranged on an end of said first contact arm opposite said first contact.

* * * * *